US007845759B2

(12) United States Patent
Umeda

(10) Patent No.: US 7,845,759 B2
(45) Date of Patent: Dec. 7, 2010

(54) DROPLET EJECTING DEVICE HAVING FLOW ADJUSTING MEMBER

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 205 days.

(21) Appl. No.: 12/198,882

(22) Filed: Aug. 26, 2008

(65) Prior Publication Data

US 2009/0058969 A1 Mar. 5, 2009

(30) Foreign Application Priority Data

Aug. 28, 2007 (JP) ..... 2007-220933

(51) Int. Cl.
*B41J 2/165* (2006.01)
*B41J 2/015* (2006.01)
*B41J 2/19* (2006.01)

(52) U.S. Cl. ..... 347/30; 347/20; 347/92

(58) Field of Classification Search ..... 347/23, 347/29, 30, 20, 85, 86, 92
See application file for complete search history.

(56) References Cited

U.S. PATENT DOCUMENTS 4,368,478 A * 1/1983 Koto ..... 347/86
5,488,401 A * 1/1996 Mochizuki et al. ..... 347/86
5,812,155 A 9/1998 Seccombe
6,257,714 B1 7/2001 Seccombe
6,305,778 B1 * 10/2001 Kobayashi et al. ..... 347/30
6,517,189 B2 2/2003 Ogawa et al.

FOREIGN PATENT DOCUMENTS

JP H09-164703 A 6/1997
JP 2001232816 A 8/2001
JP 2005199600 A 7/2005
JP 2006095868 A 4/2006

* cited by examiner

*Primary Examiner*—Shih-wen Hsieh
(74) *Attorney, Agent, or Firm*—Baker Botts L.L.P.

(57) ABSTRACT

A droplet ejecting device includes a droplet ejecting head, a channel member, a suction section, and a flow adjusting member. The droplet ejecting head has nozzles that eject droplets. The channel member is formed with a liquid supplying channel that supplies the droplet ejecting head with liquid. The suction section sucks liquid and an air bubble in the liquid supplying channel through the nozzles. The flow adjusting member is provided in the liquid supplying channel and is formed with a low-resistance channel and a high-resistance channel. The high-resistance channel is formed integrally with the low-resistance channel and has a higher flow resistance than the low-resistance channel.

12 Claims, 10 Drawing Sheets

DROPLET EJECTING DEVICE HAVING FLOW ADJUSTING MEMBER

CROSS REFERENCE TO RELATED APPLICATIONS

This application claims priority from Japanese Patent Application No. 2007-220933 filed Aug. 28, 2007. The entire content of the priority application is incorporated herein by reference.

TECHNICAL FIELD

The invention relates to a droplet ejecting device that ejects liquid droplets.

BACKGROUND

An inkjet recording device serving as a droplet ejecting device that ejects droplets is conventionally known. The inkjet recording device records texts and images on a recording medium such as recording paper or the like, by ejecting ink droplets through nozzles. An inkjet recording device generally includes an inkjet head (droplet ejecting head) having a plurality of nozzles and an ink cartridge storing ink and connected to the inkjet head. When ink droplets are ejected from the plurality of nozzles of the inkjet head and ink is consumed, additional ink is supplied from the ink cartridge to the inkjet head.

In such an inkjet recording device, air sometimes enters a channel (ink supply channel) that connects the inkjet head with the ink cartridge, from the outside, during an exchange operation of the ink cartridge and the like. If air (air bubble) having entered the ink supply channel flow together with ink to reach the inkjet head, poor ink ejection at the nozzles may be caused. Accordingly, an inkjet recording device has been proposed in which ink is sucked through nozzles of an inkjet head with a suction pump or the like, thereby discharging an air bubble existing within an ink supply channel at the upstream side of the inkjet head through the nozzles together with ink.

For example, Japanese Patent Application Publication No. 2005-199600 discloses an inkjet recording device which has a damper chamber at a position on an ink supply channel connecting an inkjet head with an ink cartridge for absorbing pressure fluctuations of ink. When a certain amount of an air bubble is stored in the damper chamber, a suction pump sucks ink through nozzles to discharge the air bubble in the damper chamber located at the upstream side of the inkjet head through the nozzles.

SUMMARY

However, in the above-described inkjet recording device disclosed in Japanese Patent Application Publication No. 2005-199600, a strong suction force is required in order to discharge the air bubble in the damper chamber located at the upstream side of the inkjet head through the nozzles of the inkjet head, which considerably increases the amount of ink discharged through the nozzles together with the air bubble.

In view of the foregoing, it is an object of the invention to provide a droplet ejecting device having a liquid supplying channel for supplying a droplet ejecting head having nozzles with liquid, the droplet ejecting device being capable of reducing the amount of liquid that is discharged together with an air bubble when discharging the air bubble in the liquid supplying channel through the nozzles.

In order to attain the above and other objects, the invention provides a droplet ejecting device. The droplet ejecting device includes a droplet ejecting head, a channel member, a suction section, and a flow adjusting member. The droplet ejecting head has nozzles that eject droplets. The channel member is formed with a liquid supplying channel that supplies the droplet ejecting head with liquid. The suction section sucks liquid and an air bubble in the liquid supplying channel through the nozzles. The flow adjusting member is provided in the liquid supplying channel and is formed with a low-resistance channel and a high-resistance channel. The high-resistance channel is formed integrally with the low-resistance channel and has a higher flow resistance than the low-resistance channel.

BRIEF DESCRIPTION OF THE DRAWINGS

Embodiments in accordance with the invention will be described in detail with reference to the following figures wherein.

DETAILED DESCRIPTION

A droplet ejecting device according to an embodiment of the invention will be described while referring to FIGS. 1 through 8. The droplet ejecting device of the embodiment is applied to a printer that records (prints) desired texts and images on recording paper by ejecting ink droplets on recording paper from an inkjet head.

Figure 1:
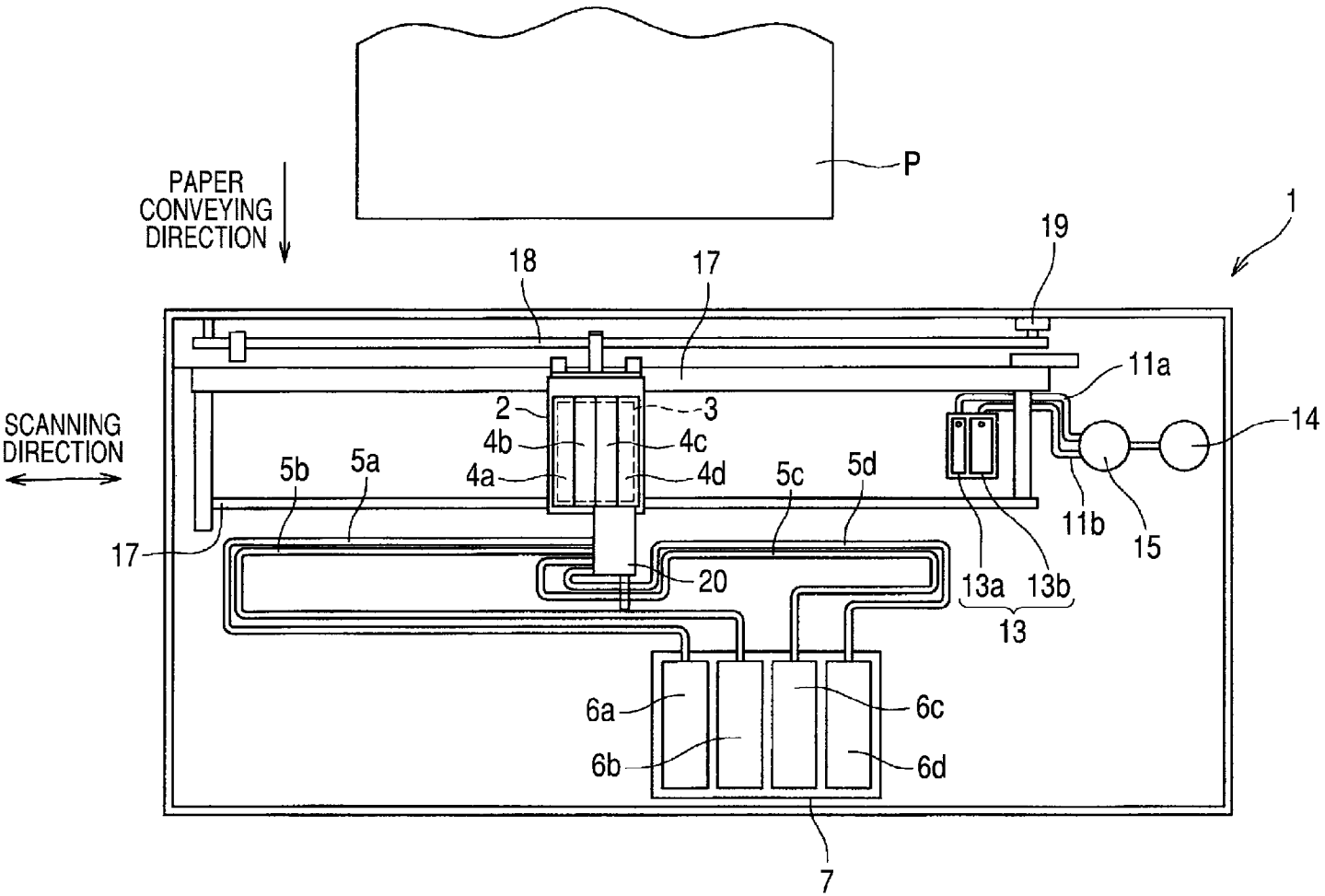
FIG. 1 is a plan view schematically showing the overall configuration of a printer according to an embodiment of the invention.

FIG. 1 is a plan view schematically showing the overall configuration of a printer 1 according to the embodiment. As shown in FIG. 1, the printer 1 (droplet ejecting device) includes a carriage 2 configured to be movable reciprocatingly in one direction (scanning direction), an inkjet head 3 (droplet ejecting head) and subsidiary tanks 4*a*-4*d* both mounted on the carriage 2, ink cartridges 6*a*-6*d* that store ink, a suction cap 13 configured to be attached to a droplet ejecting surface of the inkjet head 3, and a suction pump 14 (suction section) connected to the suction cap 13, and the like.

The carriage 2 is configured to be movable reciprocatingly along two guiding shafts 17 extending in the scanning direction (left-right direction of FIG. 1). The carriage 2 is linked to an endless belt 18 that is driven by a carriage drive motor 19. When the endless belt 18 is driven to move by the carriage drive motor 19, the carriage 2 moves in the scanning direction (left-right direction) together with the endless belt 18.

The inkjet head 3 and the four subsidiary tanks 4 (4*a*-4*d*) are mounted on the carriage 2. Nozzles 40 (see FIG. 2) are provided on the lower surface (the surface at the far side of drawing in FIG. 1) of the inkjet head 3. The inkjet head 3 moves reciprocatingly in the scanning direction together with the carriage 2, while ejecting ink droplets through the nozzles 40 on recording paper P that is conveyed in a paper conveying direction (up to down direction in FIG. 1) by a paper conveying mechanism (not shown). In this way, desired texts, images, and the like are recorded on the recording paper P.

The four subsidiary tanks 4 are juxtaposed in the scanning direction. A tube joint 20 is connected to the four subsidiary tanks 4. Flexible tubes 5*a*-5*d* are connected to the tube joint 20. The four subsidiary tanks 4*a*-4*d* are connected to the respective ones of the four ink cartridges 6*a*-6*d* via the respective ones of the flexible tubes 5*a*-5*d*.

The four ink cartridges 6*a*-6*d* store ink in four colors of black, yellow, cyan, and magenta, respectively. Each of the ink cartridges 6*a*-6*d* is detachably mounted on a holder 7. Although not shown in FIG. 1, the holder 7 is provided with a cartridge detecting sensor 85 (see FIG. 5) that detects whether the four ink cartridges 6*a*-6*d* are mounted on the holder 7. For example, the cartridge detecting sensor 85 is an optical sensor that includes a light emitting element and a light receiving element and that detects whether the ink cartridges 6*a*-6*d* are mounted based on whether light emitted from the light emitting element is blocked by the ink cartridges 6*a*-6*d* mounted on the holder 7. Alternatively, the cartridge detecting sensor 85 may be a contact-type sensor that detects that the ink cartridges 6*a*-6*d* are mounted on the holder 7 when a contact point at the holder 7 side and a contact point at the ink cartridge 6*a*-6*d* side are in contact with each other and the both contact points are in a conduction state.

Ink in four colors stored in the four ink cartridges 6*a*-6*d* is temporarily stored in the subsidiary tanks 4*a*-4*d*, respectively, and is subsequently supplied to the inkjet head 3. That is, the four subsidiary tanks 4*a*-4*d* and the tubes 5*a*-5*d* connecting the four subsidiary tanks 4*a*-4*d* with the four ink cartridges 6*a*-6*d* constitute ink supply channels that supply the inkjet head 3 with ink.

The suction cap 13 is located at a position within a reciprocating range of the carriage 2 in the scanning direction, the position being outside (the right side in FIG. 1) of a printing region in confrontation with the recording paper P (hereinafter, the position is referred to as "maintenance position"). The suction cap 13 confronts the lower surface of the inkjet head 3 (the droplet ejecting surface on which a plurality of nozzles 40 is arranged) when the carriage 2 is moved to the maintenance position. Further, the suction cap 13 is driven to move upward (the near side of the drawing in FIG. 1) by a cap drive motor 84 (see FIG. 5), and is configured to cover the plurality of nozzles 40 of the inkjet head 3.

The suction cap 13 is connected to the suction pump 14 via a switching unit 15. When the suction pump 14 is operated in a state where the suction cap 13 covers the nozzles 40 arranged on the lower surface of the inkjet head 3, ink is sucked through the nozzles 40 and discharged. With this operation, it is possible to discharge ink in the nozzles 40 with increased viscosity due to drying, and to discharge an air bubble, together with ink, that has entered the ink channel of the inkjet head 3 or the subsidiary tanks 4 through the nozzles 40, thereby recovering droplet ejecting performance of the inkjet head 3.

In the present embodiment, as shown in FIG. 1, the suction cap 13 includes a first cap section 13*a* for covering the nozzles 40 that eject black ink and a second cap section 13*b* for covering the nozzles 40 that eject ink in three colors (yellow ink, magenta ink, and cyan ink). The first cap section 13*a* and the second cap section 13*b* are separated from each other. In addition, the first cap section 13*a* and the second cap section 13*b* are connected to the switching unit 15 via two tubes 11*a* and 11*b*, respectively. The switching unit 15 is connected to the suction pump 14. Accordingly, the switching unit 15 can switch the operation of the suction pump 14 between the first cap section 13*a* and the second cap section 13*b*, thereby selecting either the nozzles 40 that eject black ink or the nozzles 40 that eject color ink for ink suction.

Figure 2:
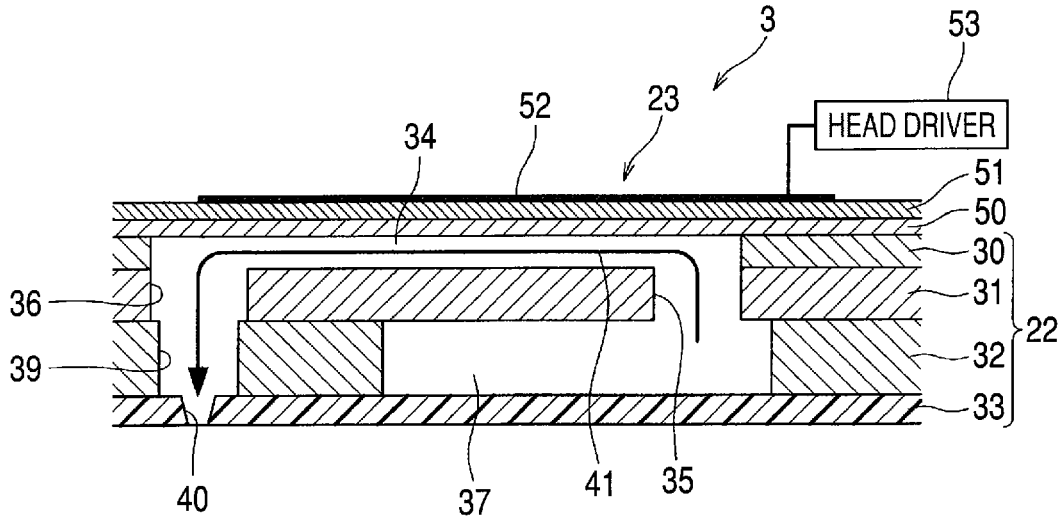
FIG. 2 is a vertical cross-sectional view of a part of an inkjet head provided in the printer shown in FIG. 1.

Next, the inkjet head 3 will be described. FIG. 2 is a vertical cross-sectional view of a part of the inkjet head 3. As shown in FIG. 2, the inkjet head 3 includes a channel unit 22 and a piezoelectric actuator 23. The channel unit 22 is formed with an ink channel including the nozzle 40 and a pressure chamber 34. The piezoelectric actuator 23 applies pressure to ink in the pressure chamber 34, thereby ejecting ink through the nozzle 40 of the channel unit 22.

The channel unit 22 includes a cavity plate 30, a base plate 31, a manifold plate 32, and a nozzle plate 33. The cavity plate 30, the base plate 31, and the manifold plate 32 are made of metal material such as stainless steel. The nozzle plate 33 is made of insulating material (for example, polymer synthetic resin material such as polyimide). These four plates 30 through 33 are bonded with each other in a layered state.

The cavity plate 30 is formed with the pressure chamber 34. Note that a plurality of pressure chambers 34 is arranged in the direction perpendicular to the surface of drawing of FIG. 2. The base plate 31 is formed with communication holes 35 and 36 in communication with the respective ones of the pressure chambers 34. The manifold plate 32 is formed with a manifold 37 in communication with the plurality of pressure chambers 34 via the communication holes 35. In addition, the manifold plate 32 is formed with communication holes 39 in communication with the communication holes 36. The nozzle plate 33 is formed with the plurality of nozzles 40 that is arranged in the direction perpendicular to the surface of the drawing of FIG. 2. The plurality of nozzles 40 is provided in one-to-one correspondence with the plurality of pressure chambers 34. With this configuration, a plurality of individual ink channels 41 is formed within the channel unit 22, each of the plurality of individual ink channels 41 being formed from the manifold 37 to the nozzle 40 via the pressure chamber 34.

The piezoelectric actuator 23 includes a metal-made vibration plate 50, a piezoelectric layer 51, and a plurality of individual electrodes 52. The vibration plate 50 is bonded with the upper surface of the channel unit 22 such that the vibration plate 50 covers the plurality of pressure chambers 34. The piezoelectric layer 51 is disposed on the upper surface of the vibration plate 50. The plurality of individual electrodes 52 is formed on the upper surface of the piezoelectric layer 51.

The metal-made vibration plate 50 is always kept to a ground potential by a head driver 53. The piezoelectric layer 51 is made of piezoelectric material including lead zirconate titanate (PZT) as the chief component, where the lead zirconate titanate is a solid solution of lead titanate and lead zirconate and is a ferroelectric substance. The piezoelectric layer 51 is arranged on the upper surface of the vibration plate 50, such that the piezoelectric layer 51 covers the plurality of pressure chambers 34. The plurality of individual electrodes 52 is arranged on the upper surface of the piezoelectric layer 51 in respective regions corresponding to the center portions of the plurality of pressure chambers 34. The head driver 53 supplies the plurality of individual electrodes 52 with either one of a ground potential and a predetermined driving potential different from the ground potential.

The operation of the piezoelectric actuator 23 during ink ejection will be described. In order to eject an ink droplet from one of the nozzles 40, the head driver 53 applies a driving potential to the individual electrode 52 corresponding to the pressure chamber 34 in communication with the nozzle 40. Then, a potential difference is generated between the individual electrode 52 to which the driving potential is applied and the vibration plate 50 kept to the ground potential, which generates an electric field through the piezoelectric layer 51 sandwiched between the individual electrode 52 and the vibration plate 50 in a direction parallel to the thickness direction. Here, if the polarization direction of the piezoelectric layer 51 is the same as the direction of the electric field, the piezoelectric layer 51 expands in the thickness direction and contracts in the surface direction. With this contraction deformation of the piezoelectric layer 51, a portion of the vibration plate 50 facing the pressure chamber 34 deforms such that the portion becomes convex toward the pressure chamber 34 side (unimorph deformation).

At this time, the volume of the pressure chamber 34 decreases. Thus, the pressure of ink in the pressure chamber 34 increases, and ink is ejected through the nozzle 40 in communication with the pressure chamber 34.

Next, the subsidiary tanks 4 that supply the inkjet head 3 with ink will be described in greater detail. Because the structures of the four subsidiary tanks 4*a*-4*d* storing ink in the respective four colors are basically identical, one of the subsidiary tanks will be described below.

Figure 3:
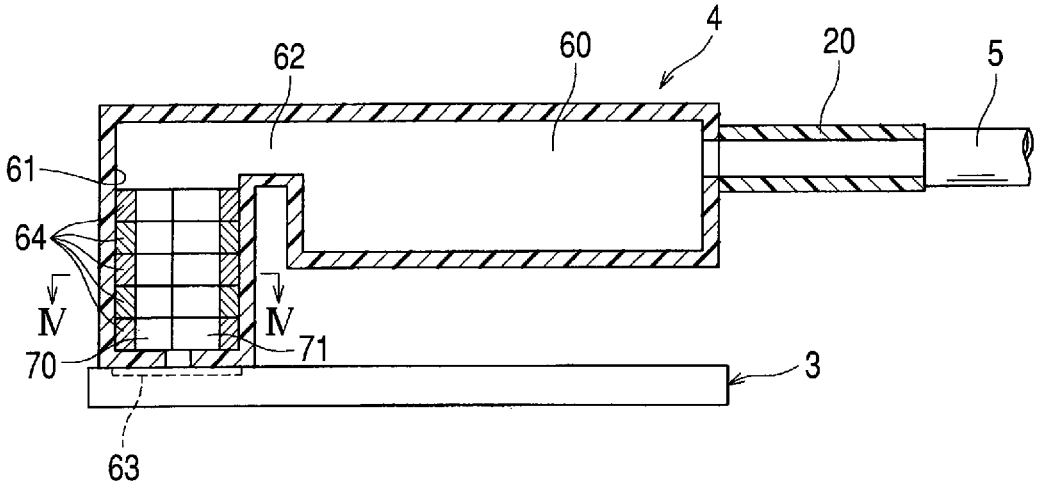
FIG. 3 is a vertical cross-sectional view of a subsidiary tank provided in the printer shown in FIG. 1.

FIG. 3 is a vertical cross-sectional view of the subsidiary tank 4. The subsidiary tank 4 is made of synthetic resin material or the like. An ink storing chamber 60 and a vertical channel 61 are formed in the subsidiary tank 4. The ink storing chamber 60 extends in a horizontal direction. The vertical channel 61 is in communication with both the ink storing chamber 60 and the inkjet head 3.

The ink storing chamber 60 is in communication with the ink cartridge 6 (see FIG. 1) via the tube 5 connected to the tube joint 20. The ink storing chamber 60 temporarily stores ink supplied from the ink cartridge 6.

The upper end section of the vertical channel 61 is located at substantially the same height as the outlet of the ink storing chamber 60 extending in the horizontal direction. The upper end section of the vertical channel 61 and the outlet of the ink storing chamber 60 are in communication with each other via a communication channel 62 which is formed horizontally. Further, the lower end section of the vertical channel 61 is connected to the inkjet head 3 (a part of the inkjet head 3 not shown in FIG. 2). A filter 63 is provided at a connection opening of the inkjet head 3 connected to the subsidiary tank 4 (the vertical channel 61). The filter 63 is for removing foreign matters and the like that have entered ink flowing from the subsidiary tank 4 toward the inkjet head 3.

Ink supplied from the ink cartridge 6 to the subsidiary tank 4 via the tube 5 is temporarily stored in the ink storing chamber 60, and then horizontally flows out of the outlet of the ink storing chamber 60 to the vertical channel 61 via the communication channel 62. Then, ink flows downward within the vertical channel 61 to pass through the filter 63, and is supplied to the inkjet head 3.

In the present embodiment, a plurality of plate-shaped flow adjusting members 64 is provided within the vertical channel 61 of the subsidiary tank 4. As will be described later, the printer 1 of the present embodiment is configured to suck ink through each of the plurality of nozzles 40 with the suction pump 14 in a state where the plurality of nozzles 40 is covered by the suction cap 13, thereby discharging an air bubble (air bubbles) in the subsidiary tank 4 through the nozzles 40 together with ink (see FIG. 8).

The plurality of flow adjusting members 64 described below is for allowing an air bubble in the subsidiary tank 4 to easily move to the inkjet head 3 during ink suction by the suction pump 14. In addition, the plurality of flow adjusting members 64 is for adjusting flow of ink and an air bubble so that an air bubble does not move to the inkjet head 3 when ink is ejected through the nozzles 40 for recording images and the like on the recording paper P, by narrowing part of the vertical channel 61.

As shown in FIG. 3, each of the flow adjusting members 64 is a plate-shaped member made of synthetic resin material or the like. The plurality (for example, five) of flow adjusting members 64 is juxtaposed in the vertical direction (the direction in which the vertical channel 61 extends, and hereinafter referred to as "channel extending direction") from a point partway in the vertical channel 61 (more specifically, a channel section slightly below the connection section between the vertical channel 61 and the communication channel 62) to the bottom surface (the connection section between the vertical channel 61 and the inkjet head 3). Each of the flow adjusting members 64 having a plate shape is arranged in such a manner that the surface direction is perpendicular to the channel extending direction of the vertical channel 61. In addition, the confronting surfaces of the adjacent flow adjusting members 64 are in contact with each other.

Among the plurality of flow adjusting members 64 juxtaposed in the up-down direction (vertical direction), the flow adjusting member 64 located at the lowest position is disposed in contact with the bottom surface of the vertical channel 61. Because the surface tension acts between the flow adjusting member 64 located at the lowest position and the bottom surface of the vertical channel 61, the plurality of flow adjusting members 64 does not move within the vertical channel 61 due to ink flow that flows downward in the vertical channel 61. However, the configuration for restricting displacement (movement) of the flow adjusting members 64 in the up-down direction is not limited to the above-described configuration. For example, the displacement of the flow adjusting members 64 in the up-down direction may be restricted by putting the flow adjusting members 64 into the vertical channel 61 by press fit in a slightly compressed state, where the flow adjusting members 64 are made of relatively soft material such as synthetic resin material. Alternatively, each of the flow adjusting members 64 may be provided with an engaging section that engages the inner surface of the vertical channel 61, and the displacement of the flow adjusting members 64 in the up-down direction may be restricted by this engagement. Note that if the displacement of the flow adjusting members 64 in the up-down direction is restricted with the above-described modified examples, it is not necessary that the flow adjusting members 64 be in contact with the bottom surface of the vertical channel 61, and the plurality of flow adjusting members 64 may be arranged at a position partway in the vertical channel 61.

Figure 4:
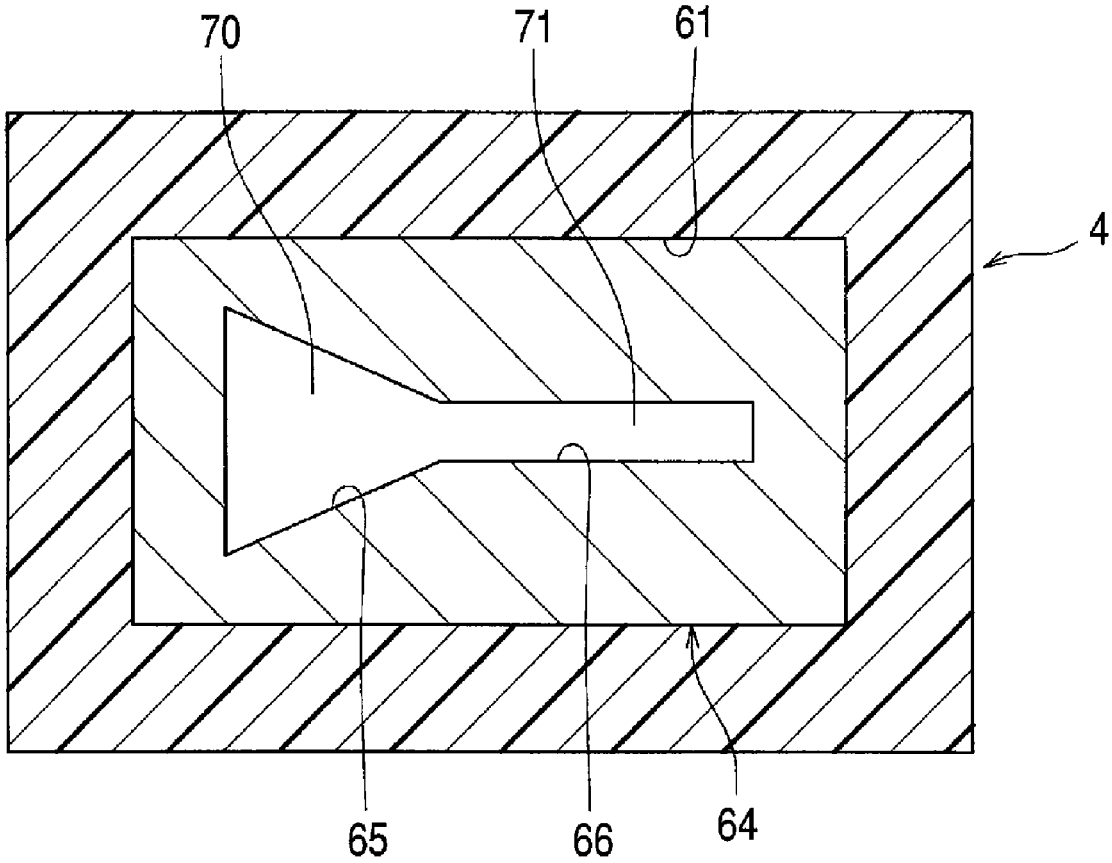
FIG. 4 is a cross-sectional view taken along a line IV-IV in FIG. 3.

FIG. 4 is a horizontal cross-sectional view taken along a line IV-IV in FIG. 3. As shown in FIG. 4, the channel cross-section (cross-section in the horizontal direction) of the vertical channel 61 has a rectangular shape. The flow adjusting members 64 are arranged within the vertical channel 61 in an orientation perpendicular to the channel extending direction, and have outer shapes of a rectangle in order to fit the shape of the vertical channel 61. Each of the flow adjusting members 64 is formed with an elongated hole 66 extending in the lengthwise direction of the rectangle and with a triangular hole 65 having a shape that widens from one end of the elongated hole 66. Here, the hole area (the area of the hole in the horizontal cross-section in FIG. 4) of the triangular hole 65 (first through-hole) is larger than the hole area of the elongated hole 66 (second through-hole). With this configuration, each of the flow adjusting members 64 is formed with a low-resistance channel 70 and a high-resistance channel 71. The low-resistance channel 70 is formed by the triangular hole 65 having a large hole area, and has a small flow resistance (channel resistance). The high-resistance channel 71 is formed by the elongated hole 66 having a small hole area, and is in communication with the low-resistance channel 70 and has a larger flow resistance than the low-resistance channel 70. The high-resistance channel 71 is formed integrally with the low-resistance channel 70. More specifically, the low-resistance channel 70 and the high-resistance channel 71 have an integrated contour (an integrated contour formed by the triangular hole 65 and the elongated hole 66 shown in FIG. 4) when viewed in a cross-section taken along a plane substantially perpendicular to the channel extending direction (the cross-section in FIG. 4).

As shown in FIG. 3, the outlet of the ink storing chamber 60 extending in the horizontal direction and the upper end section of the vertical channel 61 are connected via the horizontal communication channel 62. Hence, a large part of ink flowing into the vertical channel 61 from the ink storing chamber 60 flows downward within the vertical channel 61 along the side wall away from the communication channel 62 (the connection section between the ink storing chamber 60 and the vertical channel 61), which is the far side as viewed from the ink storing chamber 60 side (the left side in FIG. 3). Accordingly, in the vertical channel 61, the flow velocity (flow rate) is especially large in a region adjacent to the side wall at the opposite side from the ink storing chamber 60 (the side far from the ink storing chamber 60).

In addition, as shown in FIGS. 3 and 4, the low-resistance channel 70 (the triangular hole 65) of each of the flow adjusting members 64 is located in a region opposite to the connection section between the vertical channel 61 and the ink storing chamber 60 (the left side in FIG. 3). On the other hand, the high-resistance channel 71 (the elongated hole 66) extends along a horizontal surface perpendicular to the channel extending direction of the vertical channel 61, such that the high-resistance channel 71 approaches the ink storing chamber 60 from the low-resistance channel 70. Hence, the flow velocity of ink is higher in a region where the low-resistance channel 70 is located than a region where the high-resistance channel 71 is located. Here, the regions are defined in a plane perpendicular to the channel extending direction.

Figure 5:
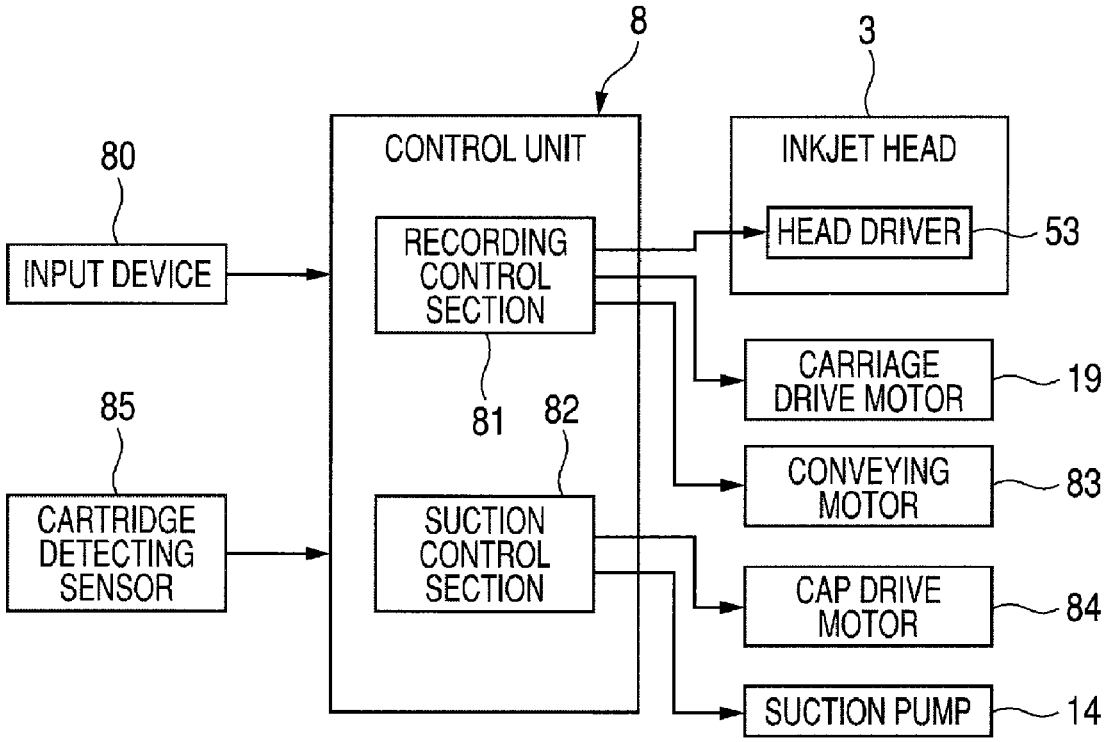
FIG. 5 is a block diagram schematically showing the electrical configuration of the printer.

Next, a control unit 8 performing the overall controls of the printer 1 will be described. FIG. 5 is a block diagram showing the electrical configuration of the printer 1. The control unit 8 shown in FIG. 5 includes a CPU (Central Processing Unit), a ROM (Read Only Memory) that stores various programs, data, etc. for controlling the overall operations of the printer 1, a RAM (Random Access Memory) that temporarily stores data etc. processed by the CPU, and the like.

The control unit 8 includes a recording control section 81 and a suction control section 82. The recording control section 81 controls the carriage drive motor 19 that drives the carriage 2 (see FIG. 1) to move reciprocatingly, the head driver 53 of the inkjet head 3, a conveying motor 83 of the paper conveying mechanism (not shown) that conveys the recording paper P, and the like based on data inputted via an input device 80 such as a personal computer, thereby performing recording of images and the like on the recording paper P. The suction control section 82 controls the cap drive motor 84 that drives the suction cap 13 to move up and down and controls the suction pump 14 to perform an ink suction operation for sucking ink through the plurality of nozzles 40 of the inkjet head 3.

The ink suction operation of the suction pump 14 controlled by the suction control section 82 will be described in detail. When the ink suction operation of the suction pump 14 is performed in a state where an air bubble exists in the subsidiary tank 4, the air bubble in the subsidiary tank 4 does not reach the inkjet head 3 and returns to the original position at the end of suction if an ink suction amount by the suction pump 14 is small (a suction period is short). Utilizing this, the suction control section 82 is capable of selecting either one of a first suction mode in which the suction amount is small and a second suction mode in which the suction amount is large, by changing the ink suction amount of the suction pump 14 during an ink suction operation.

If ink droplets are not ejected from the nozzles 40 for a long period, drying of ink increases the viscosity of ink in the ink channel of the inkjet head 3 (especially the ink within the nozzles 40). If such an increase in viscosity occurs, there is possibility that poor ejection may occur when ink droplets are ejected from the nozzles 40 for recording images and the like on the recording paper P.

Thus, if ink droplets are not ejected from the nozzles 40 for a predetermined period, the suction control section 82 selects the first suction mode in which the suction amount is small and controls the suction pump 14 to perform suction, thereby sucking ink within the ink channel of the inkjet head 3 through the nozzles 40 and discharging the ink with increased viscosity. More specifically, the recording control section 81 controls the carriage drive motor 19 to move the inkjet head 3 on the carriage 2 to the maintenance position in confrontation with the suction cap 13. In this state, the suction control section 82 controls the cap drive motor 84 to move the suction cap 13 upward so that the suction cap 13 covers the plurality of nozzles 40 of the inkjet head 3. Further, the suction control section 82 controls the suction pump 14 to perform suction of a relatively small amount (a short suction period), thereby discharging only the ink within the inkjet head 3.

On the other hand, an air bubble (air) sometimes enters the ink supply channel formed from the ink cartridge 6 to the inkjet head 3 via the subsidiary tank 4, due to various factors. For example, when the ink cartridge 6 is exchanged, air tends to enter the ink supply channel through the end section of the tube 5 connected to the ink cartridge 6. Further, it is conceivable that air gradually enters the ink supply channel through the connection section between the subsidiary tank 4 and the tube 5 or the like over a long period of time. The air having entered the ink supply channel in this way gathers to the upper end section of the subsidiary tank 4 with its buoyancy, and grows to a large air bubble. Then, if the air bubble flows into the inkjet head 3 from the subsidiary tank 4 together with ink, poor ejection of ink droplets may occur at the inkjet head 3.

Hence, if the cartridge detecting sensor 85 provided to the holder 7 (see FIG. 1) detects that the ink cartridge 6 has been exchanged or if a determination is made that an air bubble in the subsidiary tank 4 has not been discharged for a long period of time, then the suction control section 82 selects the second suction mode in which the suction amount is large and controls the suction pump 14 to perform suction, thereby discharging the air bubble in the subsidiary tank 4 through the nozzles 40 together with ink.

More specifically, like the above-described first suction mode, the suction control section 82 controls the cap drive motor 84 to move the suction cap 13 upward, and controls the suction pump 14 to perform suction of ink in a state where the suction cap 13 covers the plurality of nozzles 40. At this time, the suction control section 82 controls the suction pump 14 to suck a larger amount of ink (suction amount) through the nozzles 40 than in the first suction mode (the suction period is longer than in the first suction mode). Then, a larger amount of ink than the volume of the ink channel in the inkjet head 3 is sucked through the nozzles 40, and accordingly an air bubble in the subsidiary tank 4 is drawn into the inkjet head 3 together with ink. Further, the air bubble passes through the ink channel in the inkjet head 3 and is discharged through the nozzles 40.

In the above-described second suction mode, it is actually difficult to completely discharge an air bubble adhering to the inner surface of the subsidiary tank 4, merely by sucking ink through the nozzles 40 with the suction pump 14. However, if a stronger suction (a larger amount of suction) is performed in the second suction mode in order to completely discharge the air bubble, the amount of ink discharged through the nozzles 40 (that is, the amount of ink discarded in vain) increases.

In the printer 1 of the present embodiment, as described above, the plurality of flow adjusting members 64 is arranged within the vertical channel 61 of the subsidiary tank 4. During the ink suction operation, the plurality of flow adjusting members 64 facilitates the flow of an air bubble in the subsidiary tank 4 toward the inkjet head 3. In contrast, during a normal droplet ejecting operation (when ink droplets are ejected for recording the images and the like on the recording paper P), the plurality of flow adjusting members 64 restricts the flow of an air bubble in the subsidiary tank 4 so that the air bubble does not flow into the inkjet head 3.

Figure 6:
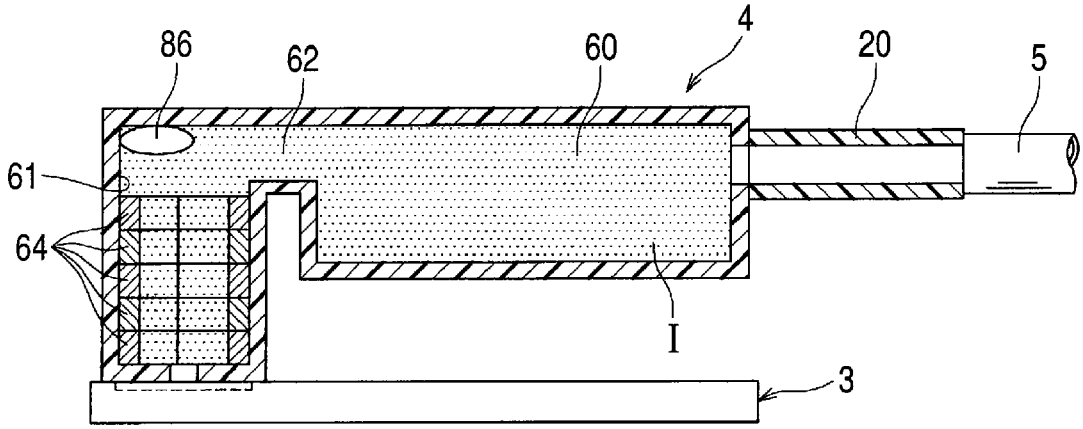
FIG. 6 is a vertical cross-sectional view of the subsidiary tank for showing a state where an air bubble stays in the subsidiary tank.

The operations of the flow adjusting members 64 will be described while referring to FIGS. 6 through 8. As shown in FIG. 6, air enters the ink supply channel which is formed from the ink cartridge 6 to the inkjet head 3, and moves upward due to its buoyancy. The air grows to a large air bubble 86 which stays at the connection section between the vertical channel 61 and the ink storing chamber 60 (the upper end section of the vertical channel 61).

Figure 7:
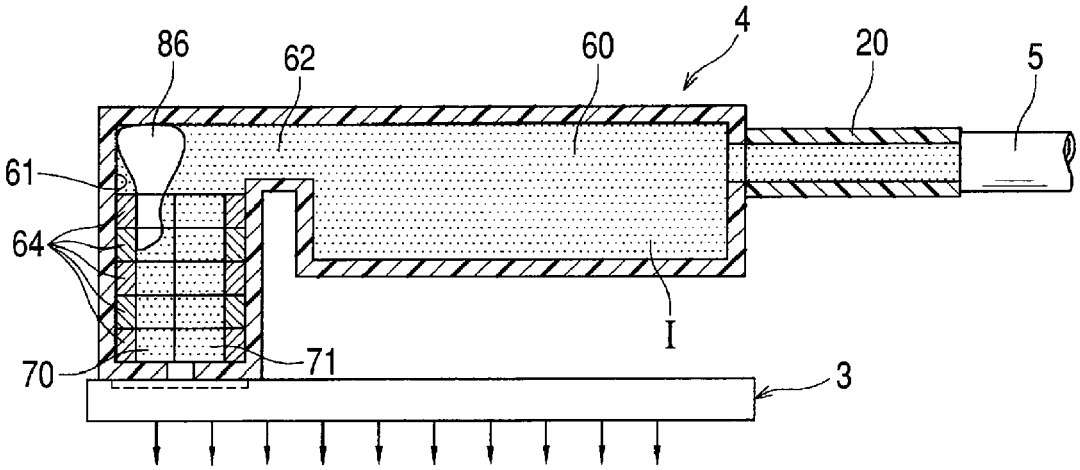
FIG. 7 is a vertical cross-sectional view of the subsidiary tank for showing a state inside the subsidiary tank during a droplet ejecting operation.

As shown in FIG. 7, when the normal droplet ejection operation (recording operation on the recording paper P) is performed through the nozzles 40 of the inkjet head 3 in a state where the air bubble 86 stays in the subsidiary tank 4, a flow of ink I moving toward the inkjet head 3 is generated within the subsidiary tank 4. The air bubble 86 gets on the flow of the ink I and enters slightly in the low-resistance channel 70 formed in the flow adjusting members 64 having a low flow resistance.

However, because the amount of the ink I discharged through the nozzles 40 is small, the flow velocity of ink within the vertical channel 61 is relatively slow. Further, because the plurality of flow adjusting members 64 is juxtaposed in the direction in which ink flows (the channel extending direction), the air bubble 86 is caught by the flow adjusting members 64 and does not reach the inkjet head 3. Additionally, the flow adjusting members 64 are formed with the high-resistance channel 71 in communication with the low-resistance channel 70, as well as the low-resistance channel 70. Hence, even if the low-resistance channel 70 is almost blocked by the air bubble 86, the ink I at the upstream side of the flow adjusting members 64 flows to the inkjet head 3 via the high-resistance channel 71. Thus, ink supply to the inkjet head 3 is not blocked by the air bubble 86.

Figure 8:
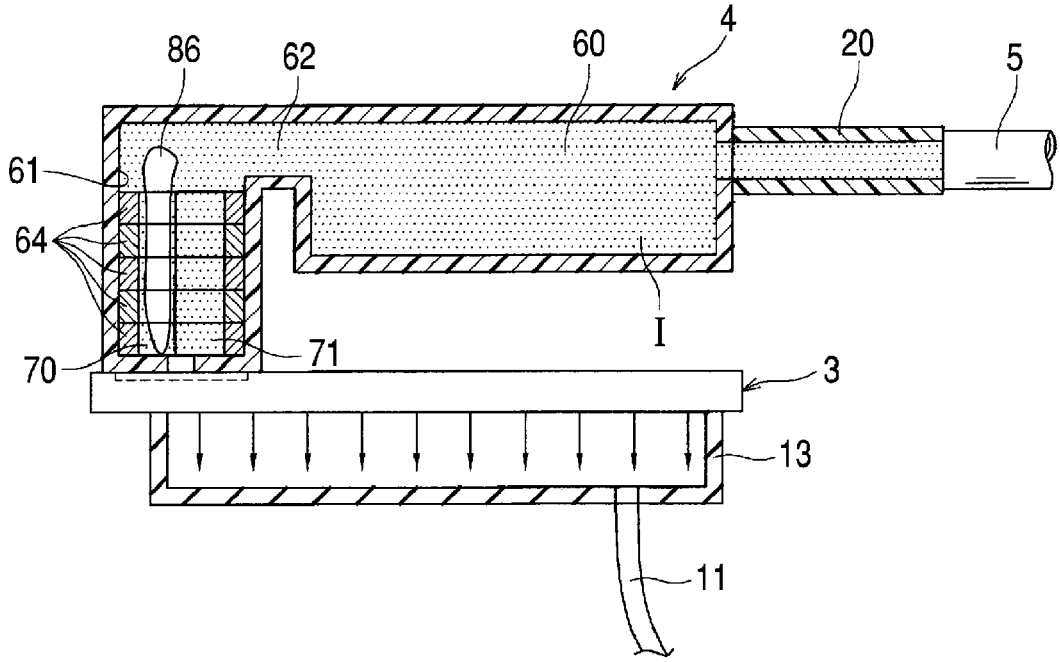
FIG. 8 is a vertical cross-sectional view of the subsidiary tank for showing a state inside the subsidiary tank during a suction operation through nozzles.

On the other hand, as shown in FIG. 8, when the suction control section 82 selects the second suction mode, the ink suction operation through the nozzles 40 is performed by the suction pump 14 in order to discharge the air bubble 86 in the subsidiary tank 4. In this operation, because a larger amount of ink I than in the droplet ejecting operation of FIG. 7 is discharged through the nozzles 40, the ink pressure at the inkjet head 3 side drops greatly, and the flow velocity of ink within the vertical channel 61 is high. Then, with the ink flow with a large flow velocity, the air bubble 86 passes through the low-resistance channel 70 formed in each of the plurality of flow adjusting members 64 to reach the inkjet head 3, and is discharged through the nozzles 40 with ink I.

At this time, because the ink flow velocity increases in the vertical channel 61, less ink flows in the high-resistance channel 71 having a high flow resistance. Hence, the amount of ink I that flows from the vertical channel 61 of the subsidiary tank 4 to the inkjet head 3 decreases, thereby reducing the amount of ink I that is discharged through the nozzles 40 together with the air bubble 86.

When the first suction mode is selected by the suction control section 82 for discharging ink with increased viscosity within the ink channel of the inkjet head 3 (especially within the nozzles 40), a large amount of ink is discharged through the nozzles 40 instantaneously. Thus, the flow velocity in the vertical channel 61 increases, and the air bubble 86 moves downward to some extent. However, the ink suction amount through the nozzles 40 in the first suction mode can be small as long as ink with increased viscosity staying in the nozzles 40 can be discharged. That is, the ink suction amount in the first suction mode can be sufficiently smaller than the ink suction amount in the second suction mode for discharging the air bubble 86. Hence, even if the air bubble 86 moves downward within the vertical channel 61 by the suction of the suction pump 14, the air bubble 86 does not reach the inkjet head 3, and returns to the upper end section of the vertical channel 61 when the suction pump 14 stops. In other words, the air bubble 86 is not sent to the inkjet head 3 when the first suction mode is selected. To put it another way, the ink suction amount in the first suction mode can be set to the ink suction amount with which the air bubble 86 does not reach the inkjet head 3, taking the volume of the vertical channel 61 and the like into consideration. Note that, because the high-resistance channel 71 is formed integrally with the low-resistance channel 70 (the high-resistance channel 71 is directly in communication with the low-resistance channel 70), the bubble 86 tends to easily return to the upper end section of the vertical channel 61 when the suction operation in the first suction mode ends.

As described above with reference to FIG. 4, the low-resistance channel 70 (the triangular hole 65) of the flow adjusting members 64 is located in a region within the vertical channel 61 where the ink flow velocity is larger than the high-resistance channel 71 (the elongated hole 66). Hence, during the ink suction through the nozzles 40 by the suction pump 14, the air bubble 86 staying at the upper end section of the vertical channel 61 tends to pass through the low-resistance channel 70 of the plurality of flow adjusting members 64, allowing the air bubble 86 to be discharged more reliably.

While the invention has been described in detail with reference to the above aspects thereof, it would be apparent to those skilled in the art that various changes and modifications may be made therein without departing from the scope of the claims. Here, like parts and components are designated by the same reference numerals to avoid duplicating description.

[1] The shape of a flow adjusting member (the shape, the location, and the like of a through-hole forming a low-resistance channel and a high-resistance channel) is not limited to the shape in the above-described embodiment (see FIG. 4). For example, the following modifications can be made (modifications 1 through 4).

First Modification

Figure 9:
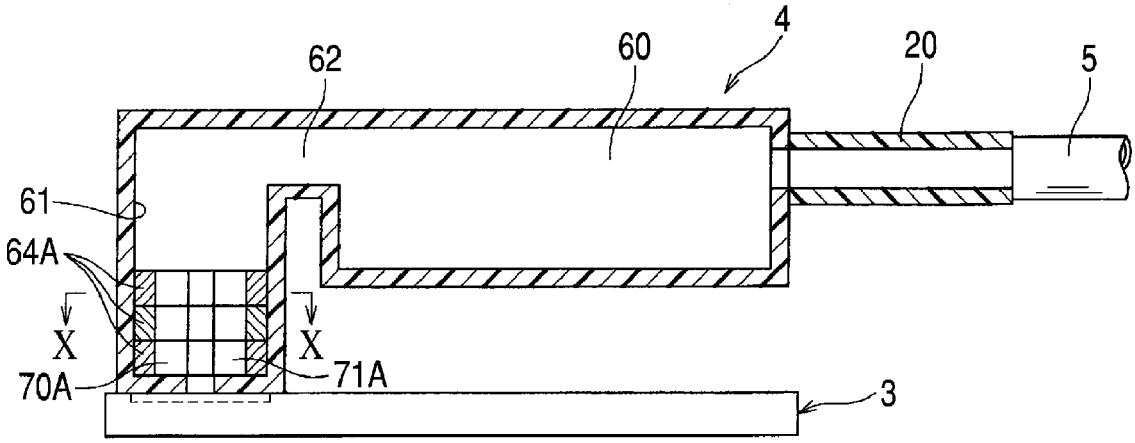
FIG. 9 is a vertical cross-sectional view of a subsidiary tank according to a first modification.

Flow adjusting members 64A according to a first modification will be described while referring to FIGS. 9 and 10. In a region within the vertical channel 61 that is away from the communication channel 62 (the connection section between the vertical channel 61 and the ink storing chamber 60), the ink flow velocity becomes the largest at the center section (in the upper-lower direction in FIG. 10) farthest away from the side walls of the vertical channel 61. Hence, if the plurality of flow adjusting member 64A is provided in such a region, as shown in FIGS. 9 and 10, it is preferable that a large through-hole 65A serving as a low-resistance channel 70A for passing an air bubble therethrough be arranged at the center region of each of the flow adjusting members 64A, and that through-holes 66A (elongated holes) serving as high-resistance channels 71A be arranged at the peripheral regions (both side regions) of the through-hole 65A.

Figure 10:
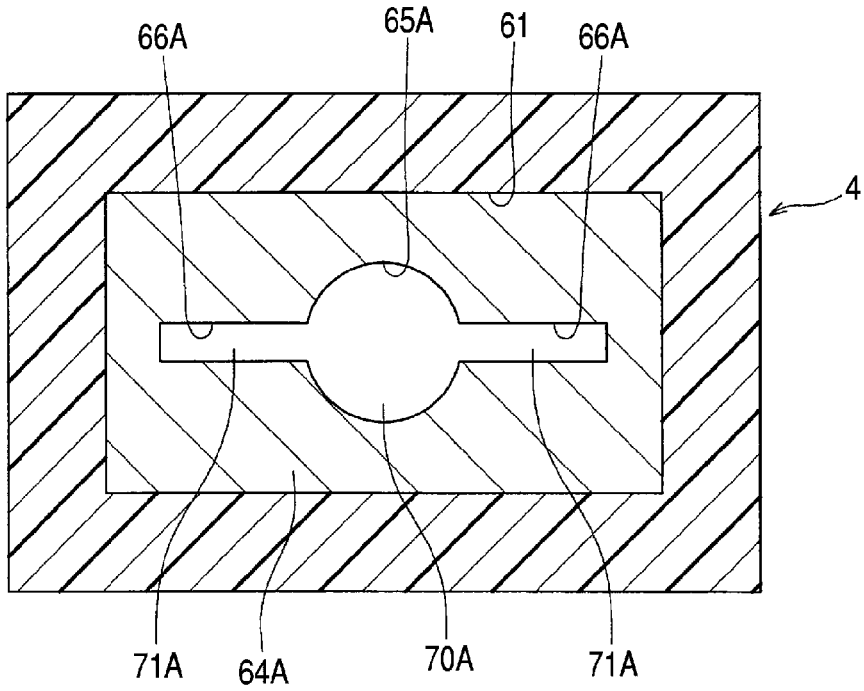
FIG. 10 is a cross-sectional view taken along a line X-X in FIG. 9.

Although the triangular hole 65 serving as the low-resistance channel 70 has a triangular shape in the above-described embodiment, the through-hole 65A serving as the low-resistance channel 70A has a circular shape as shown in FIG. 10. Alternatively, various shapes such as an elliptical shape and a rectangular shape may be used. Also, the shape of the through-hole 66A serving as the high-resistance channel 71A is not limited to an elongated-hole shape. Various shapes can be adopted as long as the high-resistance channel 71A formed by the through-hole 66A has a higher flow resistance than the low-resistance channel 70A.

Further, in the above-described embodiment, a single number of the high-resistance channel 71 is formed in each of the flow adjusting members 64. In the present modification, however, two high-resistance channels 71A are formed in each of the flow adjusting members 64A as shown in FIG. 10. In this case, as shown in FIG. 10, it is preferable that the two high-resistance channels 71A be arranged at symmetrical positions with respect to the low-resistance channel 70A, so that ink does not flow unevenly within the vertical channel 61.

In the present modification, three flow adjusting members 64A are provided in the vertical channel 61 of the subsidiary tank 4. Because a large space is provided above the flow adjusting members 64A in this example, a large amount of air bubble can be stored. Note that the number of the flow adjusting members 64A can be changed appropriately.

Second Modification

Figure 11:
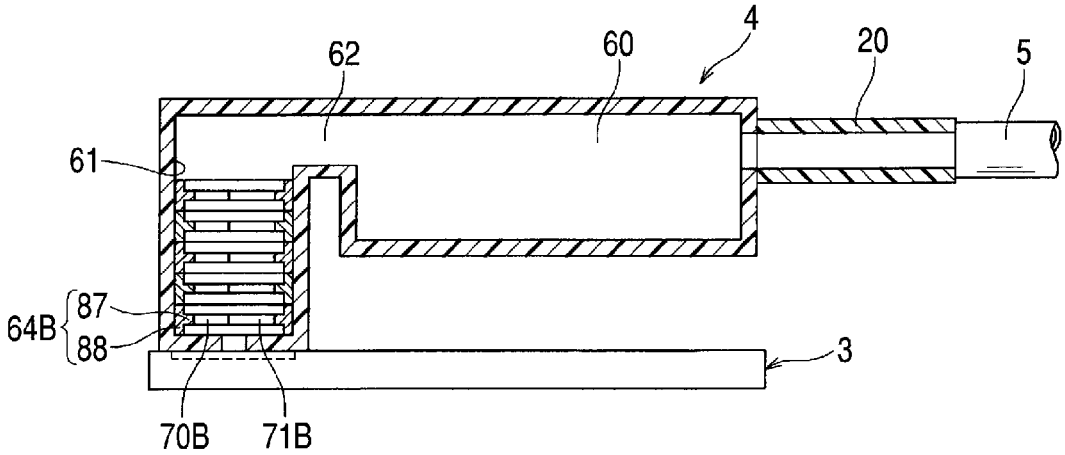
FIG. 11 is a vertical cross-sectional view of a subsidiary tank according to a second modification.

Flow adjusting members 64B according to a second modification will be described while referring to FIG. 11. In the above-described embodiment, the plurality of flow adjusting members 64 are arranged in the channel extending direction of the vertical channel 61, in a state where the confronting surfaces of the adjacent flow adjusting members 64 are in contact with each other (see FIG. 3). However, a plurality of flow adjusting members may be arranged in such a manner that at least part of the plurality of flow adjusting members are spaced away from each other in the channel extending direction, the part being formed with a through-hole for providing low-resistance and high-resistance channels. For example, as shown in FIG. 11, each of the flow adjusting members 64B of the second modification includes a horizontal plate section 87 and a tubular section 88. The horizontal plate section 87 is formed with two kinds of through-holes serving as a low-resistance channel 70B and a high-resistance channel 71B, respectively. The horizontal shapes of the low-resistance channel 70B and the high-resistance channel 71B are the same as the horizontal shapes of the low-resistance channel 70 and the high-resistance channel 71 shown in FIG. 4, respectively. The tubular section 88 is provided to the outer periphery of the horizontal plate section 87. In other words, the horizontal plate section 87 is arranged inside the tubular section 88. The horizontal plate section 87 and the tubular section 88 of the flow adjusting member 64B are formed as an integral part in an example shown in FIG. 11. Alternatively, the horizontal plate section 87 and the tubular section 88 may be formed separately and then be joined with each other. The tubular sections 88 of the two flow adjusting members 64B adjacent to each other in the channel extending direction (the vertical direction) are in contact with each other, whereas the horizontal plate sections 87 of the two flow adjusting members 64B adjacent to each other are not in contact with each other. That is, the horizontal plate sections 87 of the plurality of flow adjusting members 64B are arranged with spaces therebetween in the channel extending direction.

Third Modification

Figure 12:
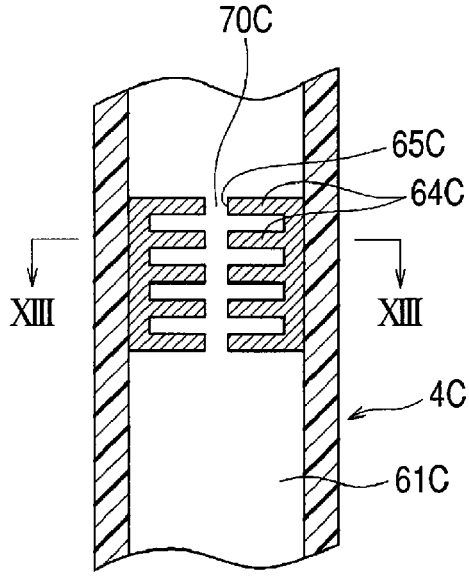
FIG. 12 is a vertical cross-sectional view (taken along a line XII-XII in FIG. 13) of a part of a vertical channel in a subsidiary tank according to a third modification.

Flow adjusting members 64C according to a third modification will be described while referring to FIGS. 12 and 13. FIG. 12 is an enlarged vertical cross-sectional view (taken along a line XII-XII in FIG. 13) of a part of a vertical channel 61C in a subsidiary tank 4C according to the third modification. As shown in FIG. 12, the plurality of flow adjusting members 64C is arranged with spaces therebetween in the channel extending direction of the vertical channel 61C of the subsidiary tank 4C. In the third modification, the plurality of flow adjusting members 64C is formed as an integral part from synthetic resin material or the like. Although the plurality of flow adjusting members 64C is arranged at a position partway in the vertical channel 61C, the flow adjusting members 64C are prevented from being displaced in the up-down direction (the vertical direction) by means of press fit to inside the vertical channel 61C, engagement with the inner surface of the vertical channel 61C, or the like.

Figure 13:
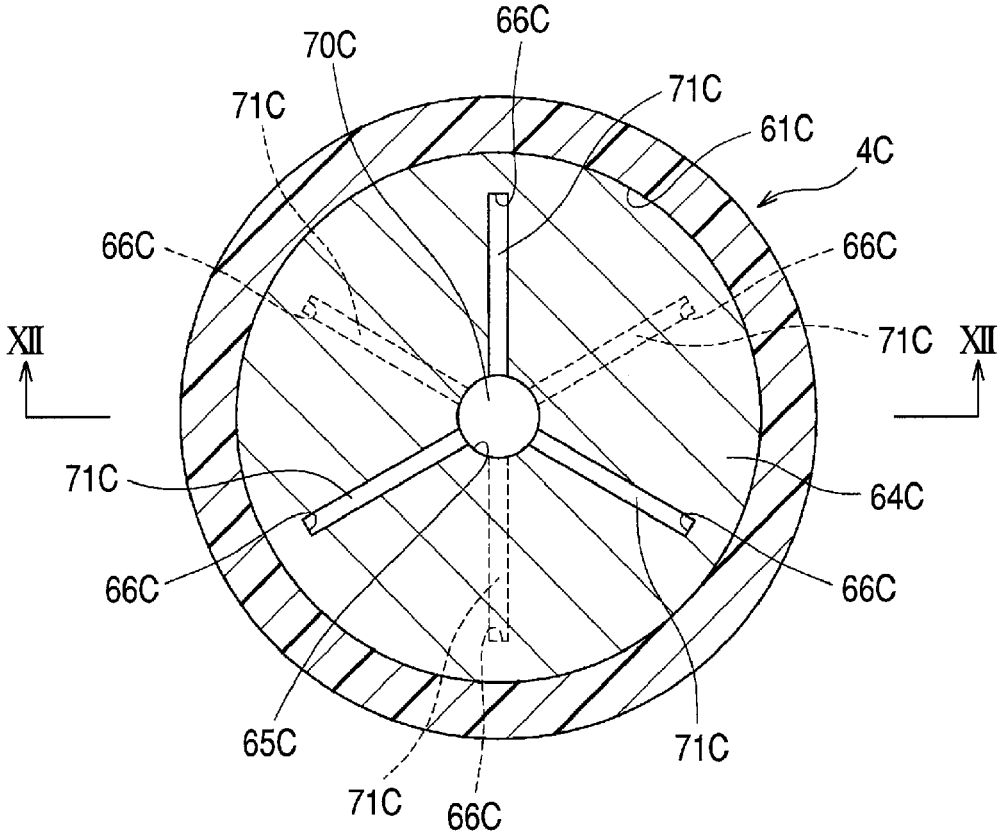
FIG. 13 is a cross-sectional view taken along a line XIII-XIII in FIG. 12.

FIG. 13 is a horizontal cross-sectional view taken along a line XIII-XIII in FIG. 12. As shown in FIG. 13, in the third modification, the channel cross-section of the vertical channel 61C has a circular shape, and the outer shapes of the flow adjusting members 64C arranged within the vertical channel 61C are also circular. A circular through-hole 65C serving as a low-resistance channel 70C is formed in a center region of each of the flow adjusting members 64C. In addition, three elongated holes 66*c* serving as high-resistance channels 71C are formed in the peripheral region of the through-hole 65C, the three elongated holes 66C being in communication with the through-hole 65C and extending outwardly in the radial directions. In the third modification, it is preferable that the three high-resistance channels 71C be arranged at equal intervals in the circumferential direction (120 degrees interval in FIG. 13), so that ink does not flow unevenly within the vertical channel 61C.

As shown in FIG. 13, concerning the two flow adjusting members 64C adjacent to each other in the channel extending direction of the vertical channel 61C, the positions of the low-resistance channel 70C provided in the respective center regions are substantially aligned with each other, while the directions in which the three high-resistance channels 71C extend from the low-resistance channel 70C are shifted by 60 degrees (the elongated hole 66C of the flow adjusting member 64C at the near side in the drawing of FIG. 13 shown in the solid lines, and the elongated hole 66C of the flow adjusting member 64C at the far side in the drawing of FIG. 13 shown in the dotted lines). According to this configuration, the overall flow resistance of the plurality of low-resistance channels 70C formed in the respective ones of the plurality of flow adjusting members 64C becomes small, which allows an air bubble to pass through the low-resistance channels 70C easily during the suction through the nozzles 40 by the suction pump 14. In contrast, the high-resistance channels 71C of the flow adjusting members 64C arranged adjacently with a space in the channel extending direction extend in directions different from each other, and do not overlap each other when viewed in the channel extending direction. Thus, because the overall flow resistance of the plurality of high-resistance channels 71C becomes large, less ink can flow in the high-resistance channel 71C during suction, which further reduces the amount of ink discharged through the nozzles 40.

Fourth Modification

Flow adjusting members 64D according to a fourth modification will be described while referring to FIGS. 14 through 17. The flow adjusting members 64C in the above-described third modification are parallel to the horizontal surface perpendicular to the channel extending direction (see FIG. 12). In contrast, in the fourth modification shown in FIGS. 14 and 15, the flow adjusting members 64D are slanted toward the upstream side with respect to the horizontal surface perpendicular to the channel extending direction of a vertical channel 61D of a subsidiary tank 4D, in a state where suction is not performed by the suction pump 14.

Figure 14:
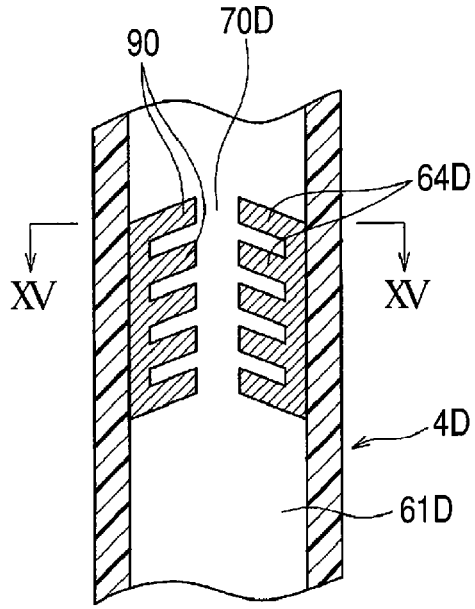
FIG. 14 is a vertical cross-sectional view (taken along a line XIV-XIV in FIG. 15) of a part of a vertical channel in a subsidiary tank according to a fourth modification, wherein a suction operation is not performed.
Figure 15:
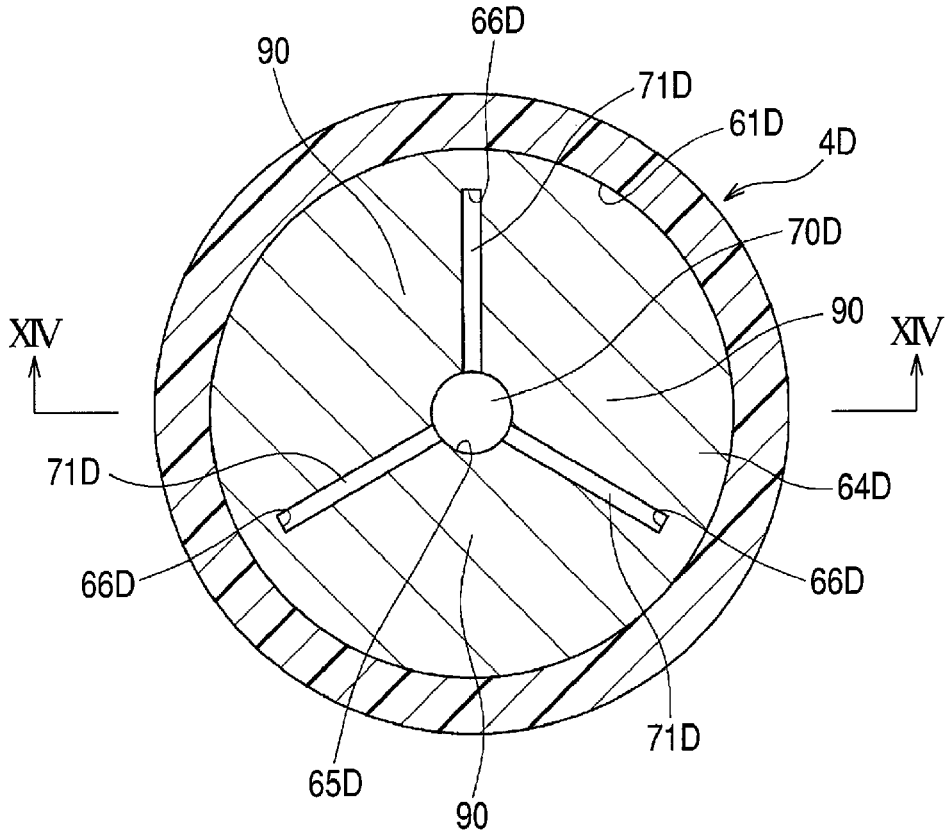
FIG. 15 is a cross-sectional view taken along a line XV-XV in FIG. 14.

More specifically, as shown in FIG. 15, each of the flow adjusting members 64D is formed with a through-hole 65D serving as a low-resistance channel 70D and three elongated holes 66D serving as three high-resistance channels 71D. Hence, each of the flow adjusting members 64D has three fin sections 90 that are separated by the through-hole 65D and the three elongated holes 66D. The three fin sections 90 are arranged in the peripheral region of the through-hole 65D at equal intervals in the circumferential direction. Each of the flow adjusting members 64D is made of flexible material such as synthetic resin material, and thus the distal end portions of the three fin sections 90 separated by the through-hole 65D and the elongated holes 66D can deform in a bending manner upward and downward. As shown in FIG. 14, in a state where suction is not performed by the suction pump 14, the three fin sections 90 are slanted toward the upstream side (upward) with respect to the horizontal surface perpendicular to the channel extending direction. In this state, the channel area of the low-resistance channel 70D and the high-resistance channels 71D formed between the three fin sections 90 is relatively large.

Figure 16:
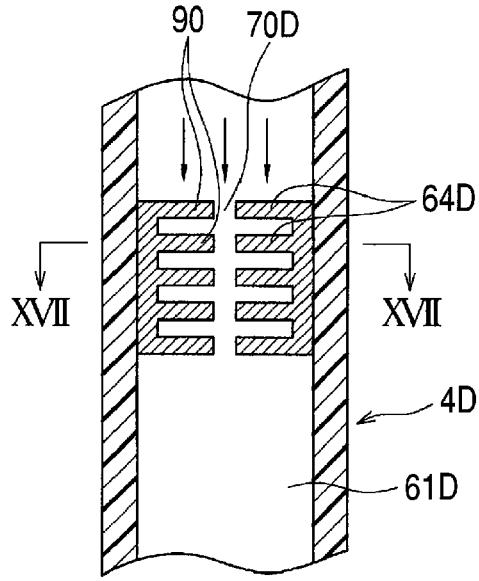
FIG. 16 is a vertical cross-sectional view (taken along a line XVI-XVI in FIG. 17) of the part of the vertical channel in the subsidiary tank according to the fourth modification, wherein a suction operation is being performed.
Figure 17:
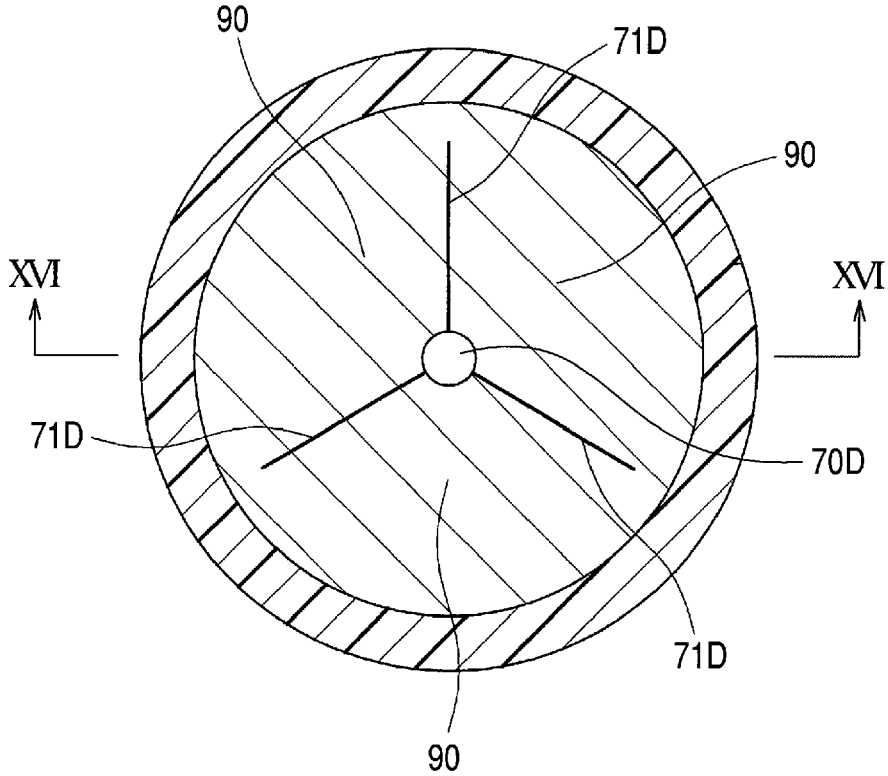
FIG. 17 is a cross-sectional view taken along a line XVII-XVII in FIG. 16.

When ink suction is performed through the nozzles 40 by the suction pump 14, the pressure at the downstream side of the plurality of flow adjusting members 64D drops, and ink flowing from the upstream side applies a downward force to the plurality of flow adjusting members 64D. At this time, as shown in FIG. 16, the three fin sections 90 of each of the flow adjusting members 64D are pushed downward and deforms in a bending manner toward the downstream side (the lower side in the vertical direction). Here, the orientation of the fin sections 90 is close to a horizontal state. Then, as shown in FIG. 17, the channel area of the low-resistance channel 70D and the high-resistance channels 71D formed between the fin sections 90 decreases. Accordingly, the ink flow velocity increases in the low-resistance channel 70D, which allows an air bubble to pass through the low-resistance channel 70D more easily. In addition, the flow resistance further increases in the high-resistance channels 71D, which suppress ink passing through the high-resistance channels 71D to flow to the downstream side.

[2] In the above-described embodiment and modifications, the flow adjusting members 64, 64A, 64B, 64C, and 64D are provided to a channel section that extends in the vertical direction, the channel section being part of the ink supply channel formed from the ink cartridge to the inkjet head. However, flow adjusting members may be provided to a channel section that extends in a direction other than the vertical direction. That is, flow adjusting members may be provided to a channel section that extends in a direction slanted by a certain angle with respect to the vertical direction, or to a channel section that extends in a horizontal direction. In these cases, the effects of adjusting flow of an air bubble and ink within the ink channel can also be obtained.

[3] In the above-described embodiment and modifications, the plurality of flow adjusting members 64, 64A, 64B, 64C, and 64D are provided in the subsidiary tank. However, a single flow adjusting member may be provided in the subsidiary tank. In addition, the number of flow adjusting members can be changed appropriately.

In the above-described embodiment and modifications, the invention is applied to an inkjet-type printer which records images and the like by ejecting ink droplets on recording paper. However, the application of the invention is not limited to such a printer. That is, the invention can be applied to various droplet ejecting devices that eject various kinds of liquid on an object, depending on the usage.

What is claimed is:

1. A droplet ejecting device comprising:

a droplet ejecting head having nozzles that eject droplets;

a channel member formed with a liquid supplying channel that supplies the droplet ejecting head with liquid;

a suction section that sucks liquid and an air bubble in the liquid supplying channel through the nozzles; and a flow adjusting member provided in the liquid supplying channel and being formed with a low-resistance channel and a high-resistance channel, the high-resistance channel being formed integrally with the low-resistance channel and having a higher flow resistance than the low-resistance channel, the low-resistance channel being in fluid communication with the nozzles to permit the air bubble to pass through the low-resistance channel toward the nozzles.

2. The droplet ejecting device according to claim 1, wherein the flow adjusting member comprises a plurality of flow adjusting members that is arranged in a channel extending direction in which the liquid supplying channel extends.

3. The droplet ejecting device according to claim 2, wherein the plurality of flow adjusting members includes two flow adjusting members adjacent to each other in the channel extending direction;

wherein the two flow adjusting members have the low-resistance channels at positions that are substantially aligned with each other; and wherein the high-resistance channels of the two flow adjusting members extend from the low-resistance channel in directions different from each other.

4. The droplet ejecting device according to claim 2, wherein each of the plurality of flow adjusting members includes:

a plate section formed with the low-resistance channel and the high-resistance channel; and a tubular section provided along a periphery of the plate section;

wherein the tubular section of the plurality of flow adjusting members is in contact with each other; and wherein the plate section of the plurality of flow adjusting members is spaced away from each other in the channel extending direction.

5. The droplet ejecting device according to claim 1, wherein the low-resistance channel and the high-resistance channel have an integrated contour when viewed in a cross-section taken along a plane substantially perpendicular to the channel extending direction.

6. The droplet ejecting device according to claim 1, wherein the flow adjusting member is formed with a first through-hole serving as the low-resistance channel and a second through-hole serving as the high-resistance channel and having a smaller opening area than the first through-hole.

7. The droplet ejecting device according to claim 1, wherein the low-resistance channel is located in a first region and the high-resistance channel is located in a second region, the first region and the second region being defined in a plane perpendicular to the channel extending direction; and wherein a flow velocity in the first region is higher than a flow velocity in the second region.

8. The droplet ejecting device according to claim 7, wherein the liquid supplying channel includes:

a horizontal section extending in a horizontal direction and having an end; and a vertical section extending in a vertical direction and having an upper end and a lower end, the upper end being connected to the end of the horizontal section, the lower end being connected to the droplet ejecting head, the flow adjusting member being arranged in the vertical section;

wherein the low-resistance channel is located at a side opposite a connecting section where the vertical section is connected to the horizontal section; and wherein the high-resistance channel extends from the low-resistance channel toward the horizontal section along a surface perpendicular to the channel extending direction.

9. The droplet ejecting device according to claim 1, wherein the flow adjusting member is made of a material having flexibility; and wherein the flow adjusting member is configured to be deformed toward a downstream side in the liquid supplying channel during a suction operation of the suction section, thereby reducing a channel area of the low-resistance channel and the high-resistance channel.

10. The droplet ejecting device according to claim 9, wherein the flow adjusting member has a plurality of fin sections that is separated from each other by the low-resistance channel and the high-resistance channel; and wherein each of the plurality of fin sections is slanted toward an upstream side with respect to a surface perpendicular to the channel extending direction in a state where the suction operation is not performed by the suction section.

11. The droplet ejecting device according to claim 1, further comprising a suction control section that controls a suction operation of the suction section, wherein the suction control section controls the suction section to change an amount of liquid sucked through the nozzles and to selectively perform either one of:

a first suction mode for discharging liquid in the droplet ejecting head; and a second suction mode for discharging, together with liquid, an air bubble in the liquid supplying channel at an upstream side of the droplet ejecting head.

12. The droplet ejecting device according to claim 1, wherein the nozzles eject ink droplets on a recording medium; and wherein the droplet ejecting device functions as an inkjet recording device.

* * * * *